US011124928B2

(12) United States Patent
Eiden et al.

(10) Patent No.: US 11,124,928 B2
(45) Date of Patent: Sep. 21, 2021

(54) ROTARY MIXING SYSTEM

(71) Applicant: Caterpillar Paving Products Inc., Brooklyn Park, MN (US)

(72) Inventors: Mark Leslie Eiden, Rogers, MN (US); Alexis James Lee, St Paul, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 74 days.

(21) Appl. No.: 16/593,085

(22) Filed: Oct. 4, 2019

(65) Prior Publication Data

US 2021/0102347 A1 Apr. 8, 2021

(51) Int. Cl.

| | |
|---|---|
| ***E01C 19/00*** | (2006.01) |
| ***E01C 23/06*** | (2006.01) |
| ***E01C 21/00*** | (2006.01) |
| ***E01C 19/10*** | (2006.01) |

(52) U.S. Cl.

CPC ..... *E01C 19/002* (2013.01); *E01C 19/1036* (2013.01); *E01C 21/00* (2013.01); *E01C 23/06* (2013.01)

(58) Field of Classification Search

CPC .... E01C 19/002; E01C 19/1036; E01C 21/00; E01C 23/06

USPC ..... 404/86–94, 128, 132

See application file for complete search history.

(56) References Cited

U.S. PATENT DOCUMENTS

| | | | | |
|---|---|---|---|---|
| 3,306,175 | A * | 2/1967 | Ferwerda | E01C 19/255 404/86 |
| 4,005,789 | A | 2/1977 | Gladwin et al. | |
| 4,352,624 | A | 10/1982 | Matsumoto | |
| 6,354,761 | B1 * | 3/2002 | Clements | E01C 19/266 404/122 |
| 6,520,717 | B1 * | 2/2003 | Otto | B60G 5/02 404/122 |
| 7,104,726 | B2 * | 9/2006 | Wallace | E01C 19/266 404/122 |
| 7,334,964 | B1 * | 2/2008 | Brown, Sr. | E01C 19/266 404/126 |
| 7,540,689 | B1 * | 6/2009 | Major, Sr. | E01C 19/266 172/611 |
| 8,246,271 | B2 * | 8/2012 | Verhoff | E01C 19/38 404/117 |
| 8,733,241 | B2 | 5/2014 | Roberge | |
| 9,506,205 | B1 | 11/2016 | Lee et al. | |

(Continued)

FOREIGN PATENT DOCUMENTS

| | | |
|---|---|---|
| GB | 2535281 | 8/2016 |

*Primary Examiner* — Raymond W Addie

(74) *Attorney, Agent, or Firm* — von Briesen & Roper, s.c.

(57) ABSTRACT

A rotary mixing system includes a construction machine. The construction machine includes a frame and a plurality of wheels rotatably mounted to the frame. The construction machine also includes a power source mounted on the frame. The construction machine further includes a milling tool rotatably mounted to the frame and adapted to be selectively coupled to the power source. The milling tool is adapted to provide a reclaimed surface on a work surface. The rotary mixing system also includes an auxiliary vehicle adapted to be removably coupled to the construction machine. The auxiliary vehicle includes a chassis and at least one compaction member rotatably mounted to the chassis. The at least one compaction member is adapted to provide a compaction pass on the reclaimed surface.

20 Claims, 5 Drawing Sheets

(56) References Cited

U.S. PATENT DOCUMENTS

| | | | | |
|---|---|---|---|---|
| 10,407,849 | B1 * | 9/2019 | Matthews | E01C 19/1077 |
| 2006/0198701 | A1 * | 9/2006 | Hall | E01C 23/14 404/91 |
| 2007/0206993 | A1 * | 9/2007 | Tyhy | E01C 19/26 404/128 |
| 2013/0216308 | A1 * | 8/2013 | Weaver | E01C 7/30 404/75 |
| 2016/0237637 | A1 | 8/2016 | Schlenker et al. | |
| 2016/0305082 | A1 | 10/2016 | Schlenker et al. | |
| 2019/0119867 | A1 | 4/2019 | Muir et al. | |

* cited by examiner

ROTARY MIXING SYSTEM

TECHNICAL FIELD

The present disclosure relates to a rotary mixing system. More particularly, the present disclosure relates to the rotary mixing system for reclaiming and compacting a work surface.

BACKGROUND

Typically, a rotary mixer is employed to reclaim and/or stabilize a work surface during a surface preparation process, such as during construction of roads. During the surface preparation process, the rotary mixer forms a reclaimed surface on the work surface using a milling tool. The reclaimed surface is then compacted using a separate compaction machine. The compaction machine is generally operated behind the rotary mixer in order to form a compaction pass on the reclaimed surface.

In many situations, a trailing vehicle may be coupled to the rotary mixer and may trail behind the rotary mixer as the rotary mixer may move on the work surface to form the reclaimed surface. The trailing vehicle may include a water supply system and/or an additive supply system and may provide water and/or additive, respectively, to the reclaimed surface. As such, the surface preparation process may require multiple machines, viz., the rotary mixer, the trailing vehicle, and the compaction machine resulting in increased equipment cost, increased labor cost, increased operator cost, increased process cost, increased process duration, and so on. Hence, there is a need for an improved rotary mixing system for such applications.

U.S. Patent Number 2019/0119867 describes a rotary mixing system having a construction machine. The construction machine includes a frame and a power source mounted on the frame. The construction machine also includes a milling tool rotatably mounted on the frame and adapted to be selectively coupled to the power source. The construction machine further includes a foaming bar mounted on the frame in association with the milling tool. The rotary mixing system also includes an auxiliary vehicle adapted to be coupled to the construction machine. The auxiliary vehicle includes a chassis and a plurality of wheels movably mounted to the chassis. The auxiliary vehicle includes a bitumen tank mounted on the chassis. The auxiliary vehicle also includes a heating element and a bitumen pump coupled to the bitumen tank. The auxiliary vehicle further includes a bitumen hose fluidly coupled to the bitumen pump and the foaming bar.

SUMMARY OF THE DISCLOSURE

In an aspect of the present disclosure, a rotary mixing system is illustrated. The rotary mixing system includes a construction machine. The construction machine includes a frame and a plurality of wheels rotatably mounted to the frame. The construction machine also includes a power source mounted on the frame. The construction machine further includes a milling tool rotatably mounted to the frame and adapted to be selectively coupled to the power source. The milling tool is adapted to provide a reclaimed surface on a work surface. The rotary mixing system also includes an auxiliary vehicle adapted to be removably coupled to the construction machine. The auxiliary vehicle includes a chassis and at least one compaction member rotatably mounted to the chassis. The at least one compaction member is adapted to provide a compaction pass on the reclaimed surface.

In another aspect of the present disclosure, an auxiliary vehicle adapted to be removably coupled to a construction machine is provided. The auxiliary vehicle includes a chassis and at least one compaction member rotatably mounted to the chassis. The at least one compaction member is adapted to provide a compaction pass on a reclaimed surface provided by the construction machine.

In yet another aspect of the present disclosure, a method for compacting a work surface is provided. The method includes providing a construction machine having a milling tool mounted thereon. The method includes removably coupling an auxiliary vehicle to the construction machine. The auxiliary vehicle has at least one compaction member. The method also includes providing a reclaimed surface on the work surface by the milling tool. The method further includes providing a compaction pass on the reclaimed surface by the compaction member.

Other features and aspects of this disclosure will be apparent from the following description and the accompanying drawings.

DETAILED DESCRIPTION

Figure 1:
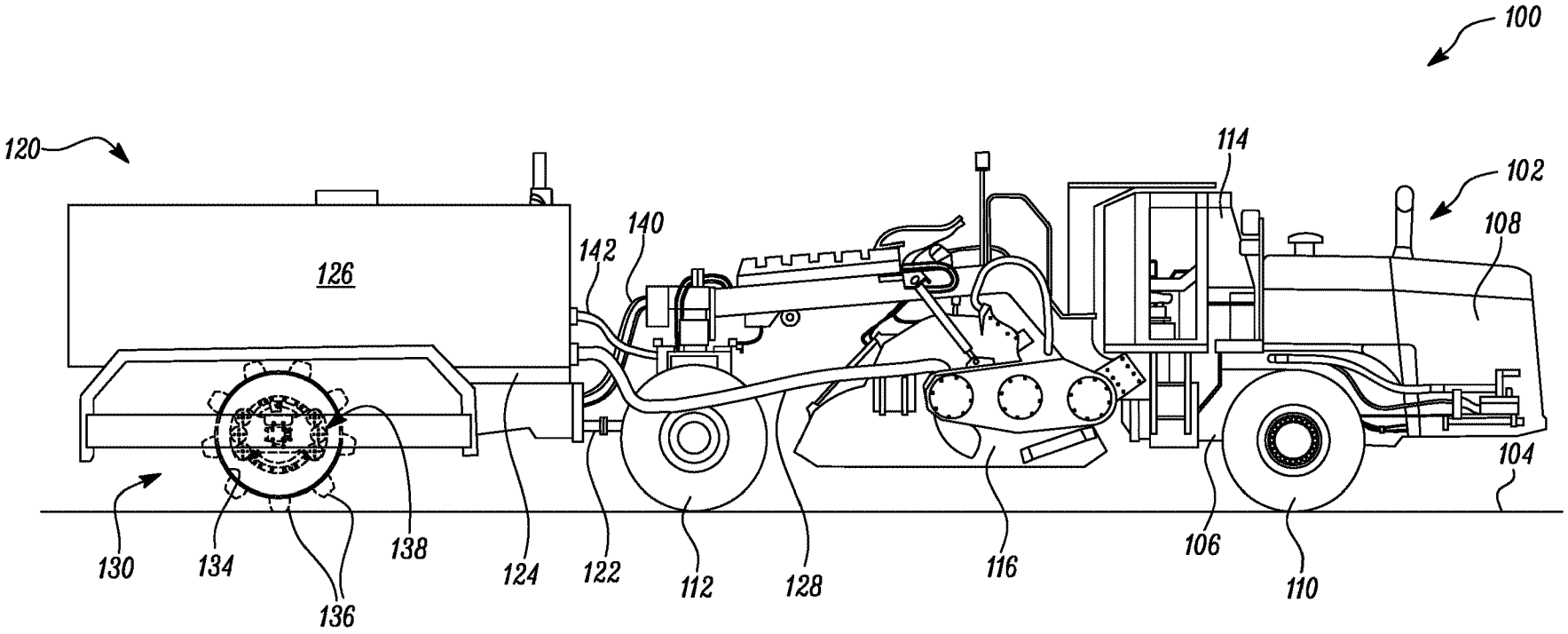
FIG. 1 is a side view of an exemplary rotary mixing system, according to one embodiment of the present disclosure.

Wherever possible, the same reference numbers will be used throughout the drawings to refer to the same or like parts. Referring to FIG. 1, an exemplary rotary mixing system 100 is illustrated. The rotary mixing system 100 will be hereinafter interchangeably referred to as "the system 100. The system 100 includes a construction machine 102. The construction machine 102 will be hereinafter interchangeably referred to as "the machine 102. More specifically, the machine 102 is a rotary mixer. The machine 102 may be employed for reclaiming and stabilizing a work surface 104. The machine 102 may also be employed for preparing the work surface 104 for various purposes, such as construction of roads and buildings, for agricultural applications, and so on.

The machine 102 includes a frame 106. The frame 106 supports one or more components of the machine 102. The machine 102 includes an enclosure 108 mounted on the frame 106. The enclosure 108 houses a power source (not shown) mounted on the frame 106. The power source is adapted to provide power to the machine 102 for mobility and operational requirements. In the illustrated embodiment, the power source is an internal combustion engine powered by a fuel, such as diesel, gasoline, natural gas, and so on. In other embodiments, the power source may be any other power source, such as a motor, batteries, and so on.

The machine 102 includes a set of ground engaging members 110, 112 rotatably mounted to the frame 106. In the illustrated embodiment, the ground engaging members 110, 112 include wheels. In other embodiments, the ground engaging members 110, 112 may include tracks, and so on, based on application requirements. The ground engaging members 110, 112 support and provide mobility to the machine 102 on the work surface 104. The machine 102 also includes an operator cabin 114 mounted on the frame 106. The operator cabin 114 may include one or more operator consoles, control levers, switches, audio visual devices, steering wheel, and so on for an operator to operate and control the machine 102 on the work surface 104.

The machine 102 further includes a milling enclosure 116 mounted on the frame 106. The milling enclosure 116 is adapted to reclaim and pulverize the work surface 104. The milling enclosure 116 includes a milling tool (not shown) rotatably mounted to the frame 106. The milling tool is selectively coupled to the power source using a transmission system (not shown), such as a belt drive, a gear train, a clutch system, a hydraulic system, and so on. The milling tool may include a plurality of cutting elements, such as cutting teeth. The milling tool is adapted to reclaim material from the work surface 104 by cutting, scraping, milling, and so on. As such, the milling tool is adapted to provide a reclaimed surface on the work surface 104.

The system 100 also includes an auxiliary vehicle 120. The auxiliary vehicle 120 will be hereinafter interchangeably referred to as "the vehicle 120. The vehicle 120 is adapted to be selectively coupled to the machine 102 via a connector link 122. The vehicle 120 includes a chassis 124. The chassis 124 supports one or more components of the vehicle 120. The vehicle 120 also includes at least one water tank 126 mounted on the chassis 124. In the illustrated embodiment, the vehicle 120 includes a single water tank 126 mounted on the chassis 124. In other embodiments, the vehicle 120 may include multiple water tanks mounted on the chassis 124, based on application requirements.

The water tank 126 receives, stores, and delivers water therefrom. More specifically, the water is delivered to the milling enclosure 116 via a water hose 128. As such, the water hose 128 is connected between the water tank 126 and the milling enclosure 116 in order to provide a flow of water from the water tank 126 to the reclaimed surface. Additionally, the vehicle 120 may include one or more components and/or systems (not shown) associated with a water supply system, such as a water port, a water filter, a water pump, a water motor, one or more fluid control valves, nozzles, and so on, based on application requirements.

The vehicle 120 further includes at least one compaction member 130 rotatably mounted to the chassis 124. More specifically, in the illustrated embodiment, the vehicle 120 includes a single compaction member 130. In other embodiments, the vehicle 120 may include multiple compaction members. In such a situation, each of the multiple compaction members may be disposed spaced apart from one another. The compaction member 130 is adapted to provide a compaction pass on the reclaimed surface of the work surface 104. The compaction member 130 also supports and provides mobility to the vehicle 120 on the work surface 104. In some embodiments, the compaction member 130 may be adapted to steer the vehicle 120 on the work surface 104.

The compaction member 130 may be any compaction member, based on application requirements. For example, in one embodiment, the compaction member 130 may be a smooth type compaction drum 134 (shown in solid line). In another embodiment, the compaction member 130 may include a number of pads 136 (shown in broken lines). As such, the compaction member 130 may be a padded type compaction drum. In such a situation, the compaction member 130 may include the number of pads 136 disposed circumferentially spaced apart from one another on the compaction member 130.

Also, the number of pads 136 may be positioned in one or more rows on the compaction member 130, based on application requirements. In some embodiments, the compaction member 130 may be a vibratory type compaction drum. In such a situation, a vibratory mechanism 138 (shown in broken lines) may be disposed in association with the compaction member 130. As such, the compaction member 130 may be any one of the smooth type compaction drum 134 or the padded type compaction drum, based on application requirements.

Figure 2:
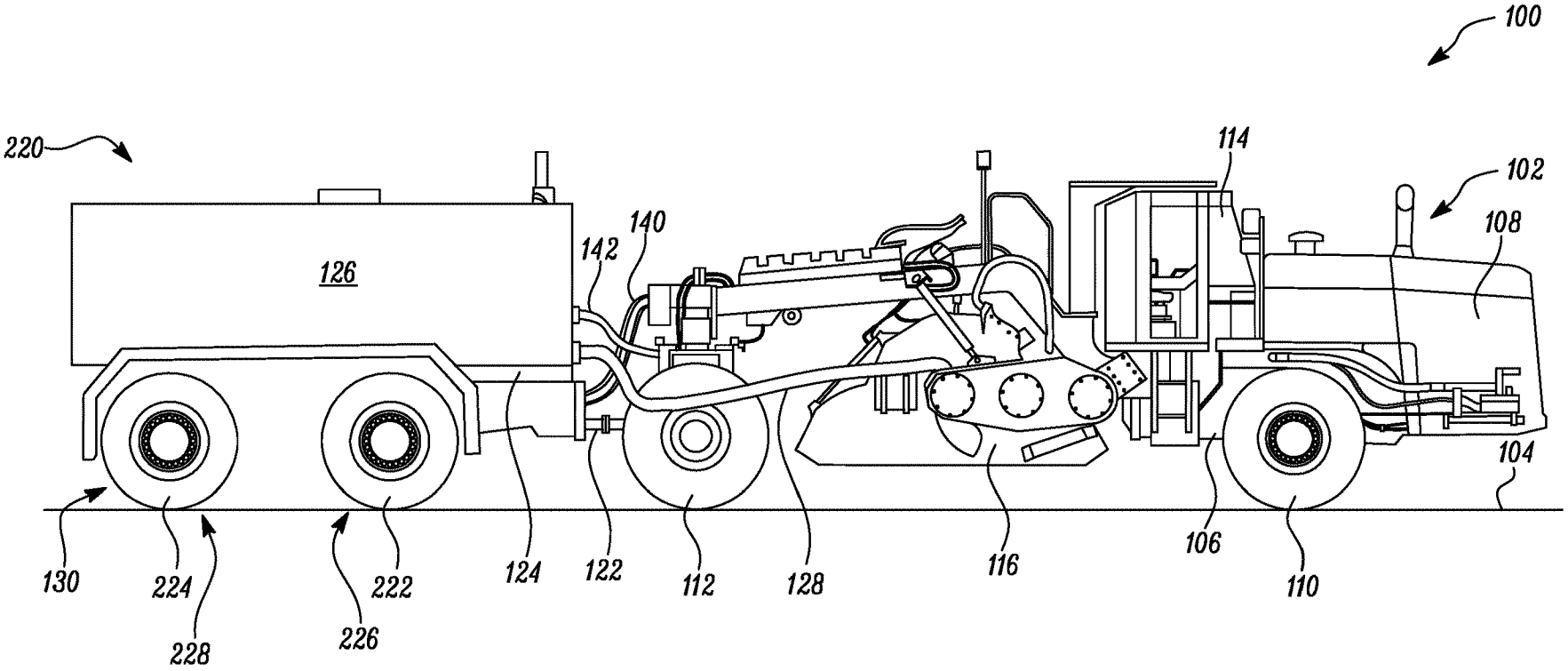
FIG. 2 is a side view of another exemplary rotary mixing system, according to another embodiment of the present disclosure.

Referring to FIG. 2, another embodiment of the vehicle 220 is illustrated. In the illustrated embodiment, the at least compaction member 130 includes a number of pneumatic rollers 222, 224. In the illustrated embodiment, the vehicle 220 includes two sets of pneumatic rollers 222, 224, such as a first set 226 of pneumatic rollers 222 and a second set 228 of pneumatic rollers 224. In other embodiments, the vehicle 220 may include single or multiple sets of pneumatic rollers, based on application requirements. Also, each of the first set 226 of pneumatic rollers 222 and the second set 228 of pneumatic rollers 224 includes a number of pneumatic rollers 222, 224 (only one pneumatic roller shown in each set), respectively. In such a situation, each of the pneumatic rollers 222 of the first set 226 is disposed adjacent to one another along a width (not shown) of the vehicle 220. Also, each of the pneumatic rollers 224 of the second set 228 is disposed adjacent to one another along the width of the vehicle 220.

Figure 3:
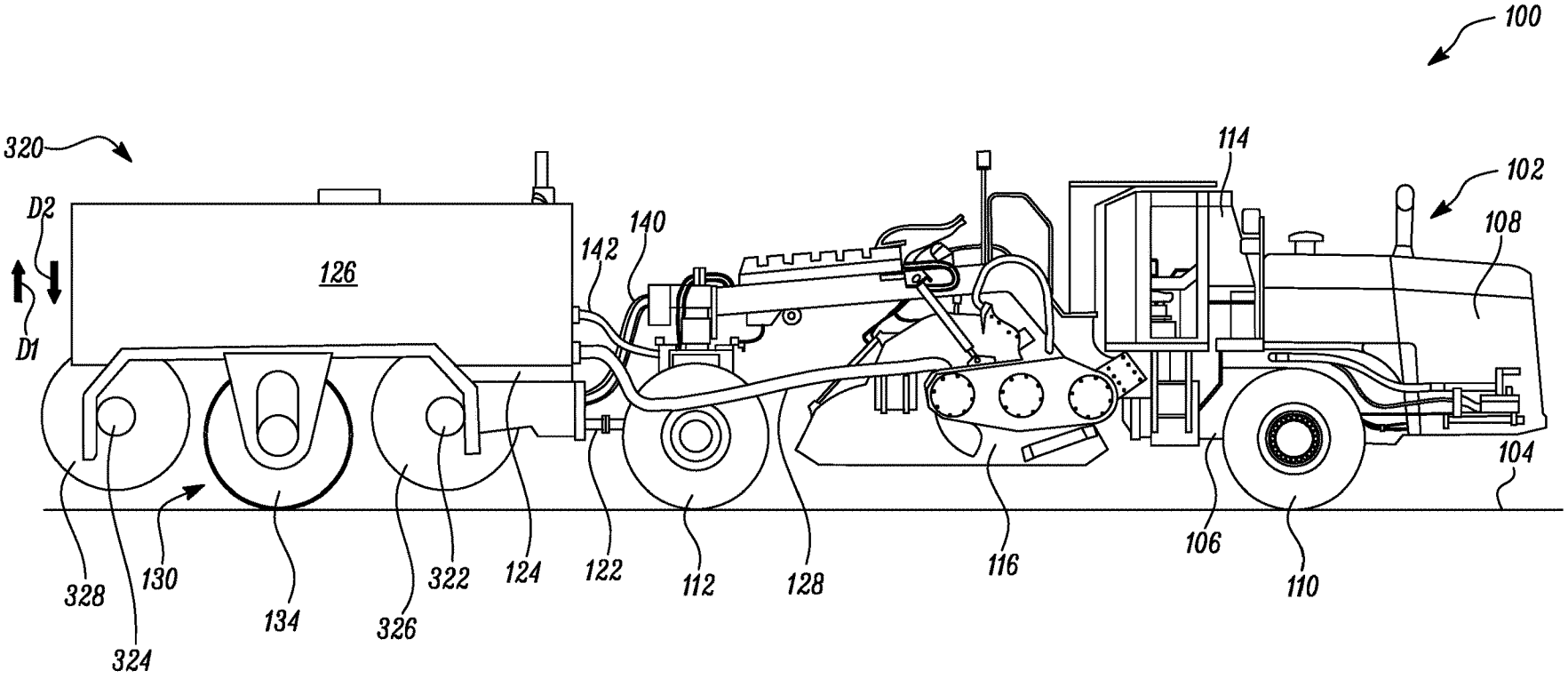
FIG. 3 a side view of another exemplary rotary mixing system, according to another embodiment of the present disclosure.

Referring to FIG. 3, another embodiment of the vehicle 320 is illustrated. In the illustrated embodiment, the vehicle 320 includes at least one auxiliary axle coupled to the chassis 124. More specifically, in the illustrated embodiment, the vehicle 320 includes a number of auxiliary axles, such as a first auxiliary axle 322 and a second auxiliary axle 324. In other embodiments, the vehicle 320 may include single or multiple auxiliary axles, based on application requirements. Also, the vehicle 320 includes a plurality of auxiliary wheels rotatably mounted to the at least one auxiliary axle.

More specifically, in the illustrated embodiment, the vehicle 320 includes a number of auxiliary wheels, such as a number of first auxiliary wheels 326 rotatably mounted to the first auxiliary axle 322 and a number of second auxiliary wheels 328 rotatably mounted to the second auxiliary axle 324 (only one first auxiliary wheel and one second auxiliary wheel shown in accompanying figure). Each of the first auxiliary wheels 326 and the second auxiliary wheels 328 supports and provides mobility to the vehicle 320 on the work surface 104.

Additionally, the vehicle 320 includes the compaction member 130 as described with reference to FIG. 1. In the illustrated embodiment, the compaction member 130 is the smooth type compaction drum 134. In other embodiments the compaction member 130 may be any other compaction drum, such as the padded type compaction drum, the vibratory type compaction drum, the pneumatic rollers 222, 224, and so on, based on application requirements.

In the illustrated embodiment, the compaction member 130 is retractable relative to the chassis 124 of the vehicle 320. As such, during transportation of the vehicle 320 from one location to another location, the compaction member 130 may be retracted relative to the chassis 124 in a direction "D1" in order to lift the compaction member 130 relative to the work surface 104. In such a situation, the vehicle 320 may be supported and transported on the work surface 104 using each of the first auxiliary wheels 326 and the second auxiliary wheels 328. Further, during compaction of the work surface 104, the compaction member 130 may be extended relative to the chassis 124 in a direction "D2" in order to lower the compaction member 130 on the work surface 104. As such, the vehicle 320 may be supported on the work surface 104 using the compaction member 130.

In another embodiment, each of the first auxiliary axle 322 and the second auxiliary axle 324 may be retractable relative to the chassis 124 of the vehicle 320. As such, during compaction of the work surface 104, each of the first auxiliary axle 322 and the second auxiliary axle 324 may be retracted relative to the chassis 124 in the direction "D1" in order to lift each of the first auxiliary wheels 326 and the second auxiliary wheels 328 relative to the work surface 104. In such a situation, the vehicle 320 may be supported on the work surface 104 using the compaction member 130. Further, during transportation of the vehicle 320 from one location to another location, each of the first auxiliary axle 322 and the second auxiliary axle 324 may be extended relative to the chassis 124 in the direction "D2" in order to lower each of the first auxiliary wheels 326 and the second auxiliary wheels 328 on the work surface 104. As such, the vehicle 320 may be supported and transported on the work surface 104 using each of the first auxiliary wheels 326 and the second auxiliary wheels 328.

Figure 4:
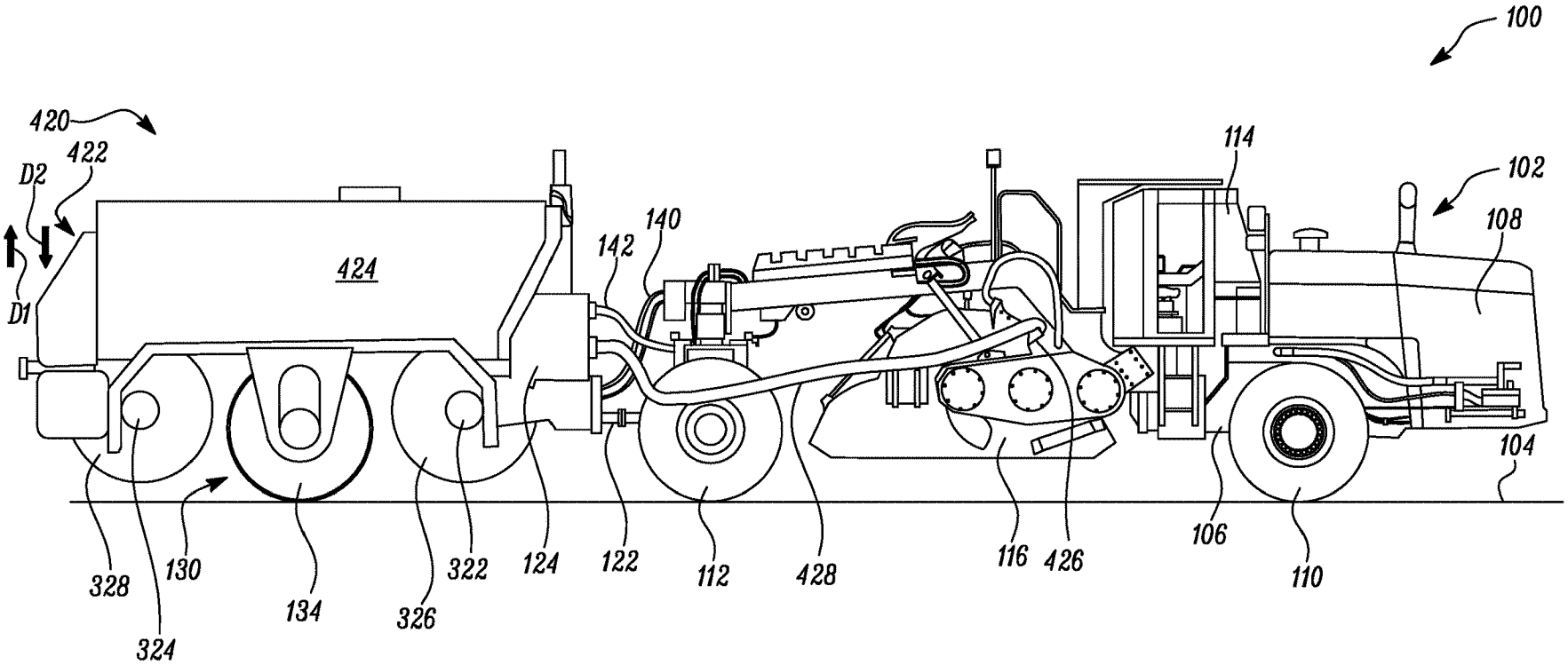
FIG. 4 a side view of another exemplary rotary mixing system, according to another embodiment of the present disclosure.

Referring to FIG. 4, another embodiment of the vehicle 420 is illustrated. In the illustrated embodiment, the vehicle 420 includes an additive supply system 422 disposed on the chassis 124. In the illustrated embodiment, the additive supply system 422 is a foamed asphalt system. In other embodiments, the additive supply system 422 may be any other additive system, based on application requirements. Accordingly, the vehicle 420 includes a bitumen tank 424 mounted on the chassis 124. The bitumen tank 424 receives, stores, and delivers bitumen therefrom. More specifically, the bitumen is delivered to a foaming bar 426 disposed adjacent to the milling enclosure 116 via a bitumen hose 428.

As such, the bitumen hose 428 is connected between the bitumen tank 424 and the foaming bar 426 in order to provide a flow of bitumen from the bitumen tank 424 to the reclaimed surface via the foaming bar 426. The vehicle 420 may also include one or more components and/or systems (not shown) associated with the additive supply system 422, such as a bitumen port, a bitumen filter, a bitumen pump, one or more flow control valves, a heating element, an auxiliary fuel tank, an auxiliary power system, an auxiliary engine, an electric generator, a hydraulic system, an air tank, an air supply system, a water tank, a water supply system, a controller, and so on, based on application requirements.

Additionally, in the illustrated embodiment, the vehicle 420 includes the compaction member 130, the first auxiliary axle 322, the first auxiliary wheels 326, the second auxiliary axle 324, and the second auxiliary wheels 328 as described with reference to FIG. 3. As such, in the illustrated embodiment, the compaction member 130 is the smooth type compaction drum 134. In other embodiments the compaction member 130 may be any other compaction drum, such as the padded type compaction drum, the vibratory type compaction drum, and so on. Also, the compaction member 130 and/or each of the first auxiliary axle 322 and the second auxiliary axle 324 may be retractable relative to the chassis 124 as described with reference to FIG. 3.

Referring to FIGS. 1 to 4, the system 100 also includes a harness 140 coupled between the machine 102 and the vehicle 120, 220, 320, 420. The harness 140 is adapted to provide electrical/electronic connection between the machine 102 and the vehicle 120, 220, 320, 420. For example, in one embodiment, the harness 140 may provide electrical/electronic connection between a power supply system (not shown) associated with the machine 102 and the water supply system associated with the vehicle 120, 220, 320. In another embodiment, the harness 140 may provide electrical/electronic connection between the power supply system associated with the machine 102 and the additive supply system 422 associated with the vehicle 420, and so on.

Additionally, or optionally, the system 100 may include one or more hydraulic hoses 142 coupled between the machine 102 and the vehicle 120, 220, 320, 420. The hydraulic hoses 142 may be adapted to provide hydraulic connection between the machine 102 and the vehicle 120, 220, 320, 420. For example, in one embodiment, the hydraulic hoses 142 may provide hydraulic connection between a hydraulic system (not shown) associated with the machine 102 and one or more of the compaction member 130, the first auxiliary axle 322, the first auxiliary wheels 326, the second auxiliary axle 324, and/or the second auxiliary wheels 328 for rotation and/or steering thereof, respectively. In another embodiment, the hydraulic hoses 142 may provide hydraulic connection between the hydraulic system associated with the machine 102 and a deployment system (not shown) associated with the compaction member 130, the first auxiliary axle 322, and/or the second auxiliary axle 324 for extension or retraction thereof, respectively.

In some embodiments (not shown), the machine 102 may be wirelessly connected to the vehicle 120, 220, 320, 420. Accordingly, the vehicle 120, 220, 320, 420 may include a dedicated power source (not shown) provided thereon in order to propel the vehicle 120, 220, 320, 420 and provide power to one or more components and/or systems thereon for operational requirements. In such a situation, the connector link 122 may be omitted and the water hose 128 or the bitumen hose 428 may be provided to allow the flow of water or bitumen from the vehicle 120, 220, 320, 420 to the machine 102, respectively. Also, the machine 102 and/or the vehicle 120, 220, 320, 420 may include one or more components and/or systems (not shown) adapted to provide remote and wireless connection including, but not limited to, an image capturing device, a positioning system, and a position sensor.

In some embodiments, an operator cabin (not shown) may be provided on the vehicle 120, 220, 320, 420 in order to control the vehicle 120, 220, 320, 420, whereas the operator cabin 114 on the machine 102 may be omitted. As such, one or more parameters of the machine 102 including, but not limited to, a speed of the machine 102 with respect to the vehicle 120, 220, 320, 420, a distance of the machine 102 with respect to the vehicle 120, 220, 320, 420, and a steering of the machine 102 may be wirelessly and remotely controlled via the operator cabin on the vehicle 120, 220, 320, 420.

In some embodiments, the operator cabin 114 may be provided on the machine 102 in order to control the machine 102, whereas the operator cabin on the vehicle 120, 220, 320, 420 may be omitted. As such, one or more parameters of the vehicle 120, 220, 320, 420 including, but not limited to, a speed of the vehicle 120, 220, 320, 420 with respect to the machine 102, a distance of the vehicle 120, 220, 320, 420 with respect to the machine 102, and a steering of the vehicle 120, 220, 320, 420 may be wirelessly and remotely controlled via the operator cabin 114 on the machine 102.

In some embodiments, the operator cabin 114 may be provided on both the machine 102 and the vehicle 120, 220, 320, 420 in order to provide local control of the machine 102 and the vehicle 120, 220, 320, 420, respectively, as well as to provide wireless connection between the machine 102 and the vehicle 120, 220, 320, 420. In some situations, the operator cabin 114 may be modular in nature, such that the same operator cabin 114 may be installed on the machine 102 or the vehicle 120, 220, 320, 420, based on application requirements. In some embodiments, the operator cabin 114 may be omitted from both the machine 102 and the vehicle 120, 220, 320, 420. In such a situation, both the machine 102 and the vehicle 120, 220, 320, 420 may be remotely and wirelessly controlled via an onsite or an offsite control station (not shown).

In some embodiments, the vehicle 120, 220, 320, 420 may be remotely and wirelessly connected to multiple machines 102 simultaneously. In such a situation, multiple water hoses 128 or multiple bitumen hoses 428 may be coupled between the vehicle 120, 220, 320, 420 and the multiple machines 102 in order to provide the flow of water or bitumen from the vehicle 120, 220, 320, 420 to the multiple machines 102, respectively. In some embodiments, the remote and wireless connection between the machine 102 and the vehicle 120, 220, 320, 420 may provide continuous on-the-fly refilling of the water tank 126 or the bitumen tank 424 on the vehicle 120, 220, 320, 420, respectively.

For example, when a level of the water in the water tank 126 may drop below a predefined limit, the vehicle 120, 220, 320 may approach a water storage (not shown) or a water tanker (not shown) present on the worksite for refilling the water tank 126. During travel of the vehicle 120, 220, 320 away from the machine 102 for refilling, the water hose 128 may be connected between the vehicle 120, 220, 320 and the machine 102 based on an extended length of the water hose 128. Accordingly, the machine 102 may continue to perform a predefined operation thereof. As the vehicle 120, 220, 320 may be refilled, in some situations, the vehicle 120, 220, 320 may wait for the machine 102 to perform the operation and approach the vehicle 120, 220, 320 before continuing travel alongside the machine 102 or, in some situations, the vehicle 120, 220, 320 may travel and approach the machine 102 in order to continue travel alongside the machine 102 along an initial travel path.

In another example, when a level of the bitumen in the bitumen tank 424 may drop below a predefined limit, the vehicle 420 may approach a bitumen plant (not shown) or a bitumen tanker (not shown) present on the worksite for refilling the bitumen tank 424. During travel of the vehicle 420 away from the machine 102 for refilling, the bitumen hose 428 may be connected between the vehicle 420 and the machine 102 based on an extended length of the bitumen hose 428. Accordingly, the machine 102 may continue to perform a predefined operation thereof. As the vehicle 420 may be refilled, in some situations, the vehicle 420 may wait for the machine 102 to perform the operation and approach the vehicle 420 before continuing travel alongside the machine 102 or, in some situations, the vehicle 420 may travel and approach the machine 102 in order to continue travel alongside the machine 102 along the initial travel path.

INDUSTRIAL APPLICABILITY

Figure 5:
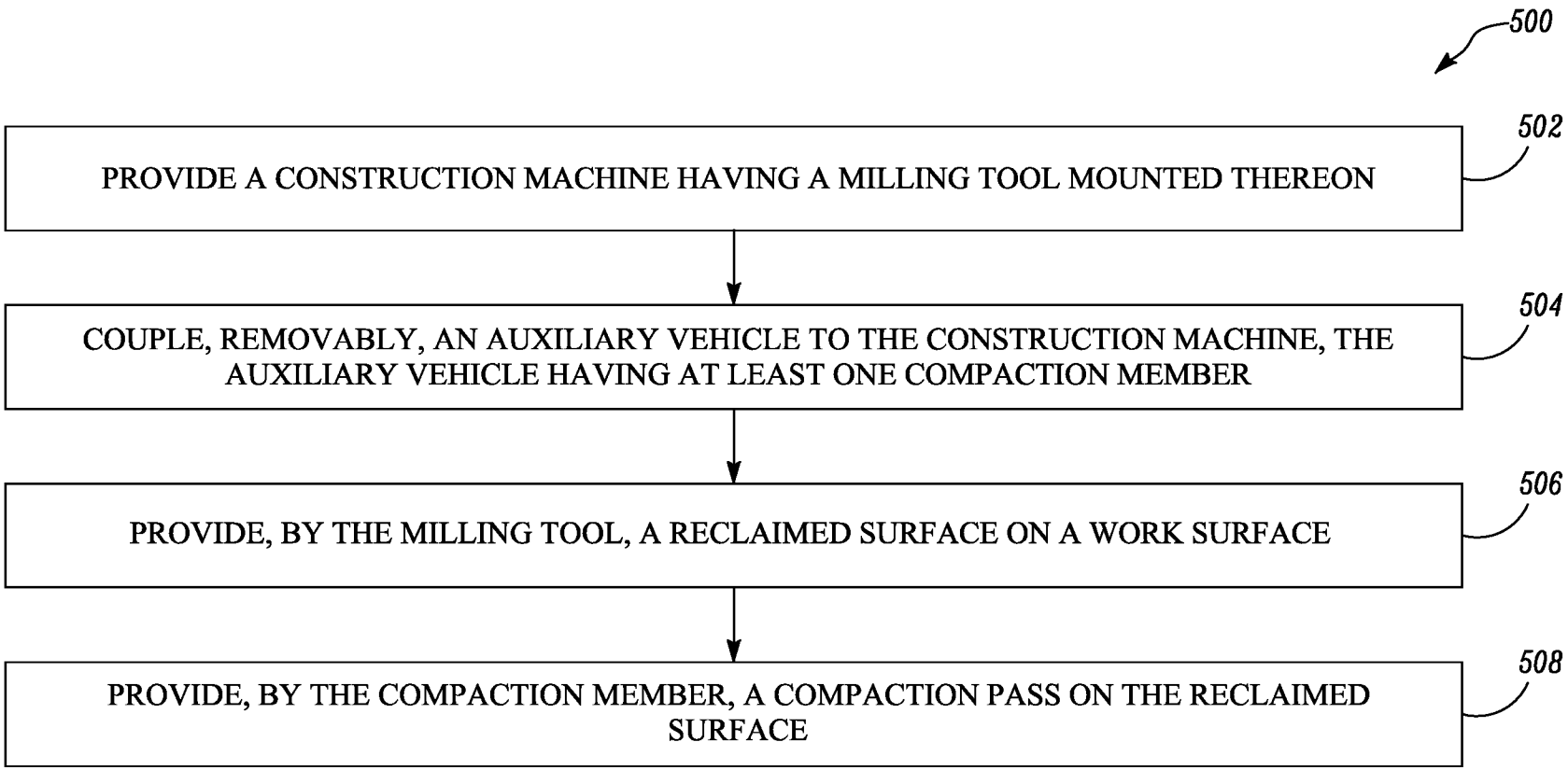
FIG. 5 is a flowchart illustrating a method for compacting a work surface using the rotary mixing system of FIGS. 1 to 4, according to one embodiment of the present disclosure.

The present disclosure relates to a method 500 for compacting the work surface 104 using the system 100. Referring to FIG. 5, a flowchart of the method 500 is illustrated. At step 502, the construction machine 102 having the milling tool mounted thereon is provided. More specifically, the milling tool is rotatably mounted to the frame 106 and is disposed within the milling enclosure 116. At step 504, the auxiliary vehicle 120, 220, 320, 420 is removably coupled to the construction machine 102. In some embodiments, the vehicle 120, 220, 320, 420 may be removably coupled to the machine 102 via the connector link 122. In some embodiments, the vehicle 120, 220, 320, 420 may be communicably coupled to the machine 102 via the wireless connection.

The auxiliary vehicle 120, 220, 320, 420 includes the at least one compaction member 130. In some embodiments, the compaction member 130 may be the compaction drum, such as the smooth type compaction drum 134, the padded type compaction drum, the vibratory type compaction drum, and so on. In some embodiments, the compaction member 130 may be the pneumatic rollers 222, 224, and so on, based on application requirements. At step 506, the reclaimed surface is provided on the work surface 104 by the milling tool. More specifically, the milling tool may be lowered relative to the frame 106 in order to contact the work surface 104 and provide the reclaimed surface on the work surface 104.

At step 508, the compaction pass is provided on the reclaimed surface by the compaction member 130. More specifically, the vehicle 120, 220, 320, 420 is trailed behind the machine 102 in order to roll the compaction member 130 over the reclaimed surface and provide the compaction pass on the reclaimed surface. In some situations, as described with reference to FIGS. 3 and 4, the compaction member 130 may be extended relative to the chassis 124 of the auxiliary vehicle 320, 420 in order to contact the reclaimed surface. In some situations, as described with reference to FIGS. 3 and 4, each of the first auxiliary axle 322 and the second auxiliary axle 324 may be retracted relative to the chassis 124 of the auxiliary vehicle 320, 420 in order to lift each of the first auxiliary wheels 326 and the second auxiliary wheels 328 relative to the reclaimed surface.

Additionally, as described with reference to FIGS. 1, 2, and 3, the flow of water is provided from the water tank 126 disposed on the auxiliary vehicle 120, 220, 320 to the reclaimed surface. More specifically, the flow of water is provided from the water tank 126 to the milling enclosure 116 via the water hose 128. In some embodiments, as described with reference to FIG. 4, the flow of additive, such as bitumen, is provided from an additive tank, such as the bitumen tank 424, disposed on the auxiliary vehicle 420 to the reclaimed surface. More specifically, the flow of bitumen is provided from the water tank 126 to the milling enclosure 116 via an additive hose, such as the bitumen hose 428.

The system 100 provides a simple, effective, and cost-efficient method to provide the compaction pass on the reclaimed surface using the vehicle 120, 220, 320, 420. As such, the vehicle 120, 220, 320, 420 may provide multiple operational purposes by supplying water or additive to the reclaimed surface and further providing the compaction pass on the reclaimed surface. As such, the vehicle 120, 220, 320, 420 may provide elimination of a separate compaction machine 102 for providing the compaction pass on the reclaimed surface, in turn, reducing process cost, reducing equipment cost, increasing process productivity, and so on.

The system 100 also provides different configurations of the vehicle 120, 220, 320, 420 in order to mount one or more components on the vehicle 120, 220, 320, 420, based on user requirements, in turn, providing system flexibility. The water tank 126 and the additive supply system 422 may provide a required dead weight on the vehicle 120, 220, 320, 420, respectively, in order to achieve a desired level of compaction for the compaction pass. Also, the single vehicle 120, 220, 320, 420 may be coupled to any machine 102 from a fleet of machines as may be required, in turn, improving operational flexibility, improving productivity of the vehicle 120, 220, 320, 420, reducing capital cost, and so on. Further, the on-the-fly refilling of the vehicle 120, 220, 320, 420 may provide continuous refilling with continuous operation of the machine 102, in turn, reducing refill time, reducing process downtime, and so on.

Also, the remote and wireless connection between the vehicle 120, 220, 320, 420 and the one or more machines 102 may provide partial or complete automation of reclamation/stabilization/compaction process, thus, reducing process error, reducing rework, reducing labor, reducing operator intervention, reducing process cost, reducing process duration, improving process efficiency, improving product quality, and so on. The compaction member 130 and/or each of the first auxiliary wheels 326 and the second auxiliary wheels 328 may be retrofitted on any water tanker or additive tanker with minimal modification to existing system, in turn, improving flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A rotary mixing system comprising:

a construction machine including:

a frame;

a plurality of wheels rotatably mounted to the frame;

a power source mounted on the frame;

a milling enclosure mounted to the frame; and a milling tool disposed in the milling enclosure and adapted to be selectively coupled to the power source, the milling tool adapted to provide a reclaimed surface on a work surface; and an auxiliary vehicle adapted to be removably coupled to the construction machine, the auxiliary vehicle including:

a chassis;

at least one compaction member rotatably mounted to the chassis and adapted to provide a compaction pass on the reclaimed surface;

a liquid tank mounted to the chassis; and a liquid hose providing fluidic coupling between the liquid tank and the milling enclosure, wherein liquid tank provides a flow of liquid to the reclaimed surface via the liquid hose and the milling enclosure, and wherein the auxiliary vehicle is adapted to be selectively decoupled from the construction machine, during which a travel path of the auxiliary vehicle is diverted away from a travel path of the construction machine, and wherein the liquid hose has an extended length sufficient to maintain fluidic coupling between the liquid tank and the milling enclosure when the travel path of the auxiliary vehicle is diverted from the travel path of the construction machine.

2. The rotary mixing system of claim 1, wherein the at least one compaction member is one of a smooth compaction drum, a padded compaction drum, and a vibratory compaction drum.

3. The rotary mixing system of claim 1, wherein the at least one compaction member is a pneumatic roller.

4. The rotary mixing system of claim 1, wherein the at least one compaction member is retractable relative to the chassis.

5. The rotary mixing system of claim 1, wherein the liquid tank comprises a water tank.

6. The rotary mixing system of claim 1, wherein the liquid tank comprises a bitumen tank.

7. The rotary mixing system of claim 1, wherein the auxiliary vehicle further includes:

at least one auxiliary axle coupled to the chassis; and a plurality of auxiliary wheels rotatably mounted to the at least one auxiliary axle.

8. The rotary mixing system of claim 7, wherein the at least one auxiliary axle is retractable relative to the chassis.

9. An auxiliary vehicle adapted to be removably coupled to a construction machine, wherein the construction machine includes a milling enclosure, and a milling tool disposed in the milling enclosure and configured to provide a reclaimed surface on a work surface, the auxiliary vehicle comprising:

a chassis;

at least one compaction member rotatably mounted to the chassis and adapted to provide a compaction pass on the reclaimed surface;

a liquid tank mounted to the chassis; and a liquid hose providing fluidic coupling between the liquid tank and the milling enclosure, wherein the liquid tank provides a flow of liquid to the reclaimed surface via the liquid hose and the milling enclosure, wherein the auxiliary vehicle is adapted to be selectively decoupled from the construction machine, during which a travel path of the auxiliary vehicle is diverted away from a travel path of the construction machine, and wherein the liquid hose has an extended length sufficient to maintain fluidic coupling between the liquid tank and the milling enclosure when the travel path of the auxiliary vehicle is diverted from the travel path of the construction machine.

10. The auxiliary vehicle of claim 9, wherein the at least one compaction member is one of a smooth compaction drum, a padded compaction drum, and a vibratory compaction drum.

11. The auxiliary vehicle of claim 9, wherein the at least one compaction member is a pneumatic roller.

12. The auxiliary vehicle of claim 9, wherein the at least one compaction member is retractable relative to the chassis.

13. The auxiliary vehicle of claim 9, wherein the liquid tank comprises a water tank.

14. The auxiliary vehicle of claim 9, wherein the liquid tank comprises a bitumen tank.

15. The auxiliary vehicle of claim 9, wherein the auxiliary vehicle further includes:

at least one auxiliary axle coupled to the chassis; and a plurality of auxiliary wheels rotatably mounted to the at least one auxiliary axle.

16. The auxiliary vehicle of claim 15, wherein the at least one auxiliary axle is retractable relative to the chassis.

17. A method for compacting a work surface, the method comprising:

providing a construction machine having a milling enclosure, and a milling tool disposed in the milling enclosure;

providing an auxiliary vehicle having a chassis, at least one compaction member rotatably mounted to the chassis, a liquid tank mounted to the chassis, and a liquid hose providing fluidic coupling between the liquid tank and the milling enclosure;

providing, by the milling tool, a reclaimed surface on the work surface;

providing, by the compaction member, a compaction pass on the reclaimed surface providing, by the liquid tank, a flow of liquid from the liquid tank on the auxiliary vehicle to the reclaimed surface via the milling enclosure; and selectively diverting a travel path of the auxiliary vehicle away from a travel path of the construction machine, wherein the liquid hose has an extended length sufficient to maintain fluidic coupling between the liquid tank and the milling enclosure when the travel path of the auxiliary vehicle is diverted from the travel path of the construction machine.

18. The method of claim 17 further includes at least one of:

extending the at least one compaction member relative to the chassis of the auxiliary vehicle, and retracting at least one auxiliary axle relative to the chassis of the auxiliary vehicle.

19. The method of claim 17, wherein the liquid tank comprises a water tank, and providing a flow of liquid comprises providing a flow of water from the water tank to the reclaimed surface.

20. The method of claim 17, wherein the at least one compaction member is one of a smooth compaction drum, a padded compaction drum, a vibratory compaction drum, and a pneumatic roller.

* * * * *